US006756987B2

(12) United States Patent
Goyins et al.

(10) Patent No.: US 6,756,987 B2
(45) Date of Patent: Jun. 29, 2004

(54) METHOD AND APPARATUS FOR INTERLEAVING READ AND WRITE ACCESSES TO A FRAME BUFFER

(75) Inventors: Gregg S. Goyins, Lincoln, CA (US); John R. McVey, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 345 days.

(21) Appl. No.: 09/839,856

(22) Filed: Apr. 20, 2001

(65) Prior Publication Data

US 2002/0154129 A1 Oct. 24, 2002

(51) Int. Cl.[7] ..... G09G 5/399

(52) U.S. Cl. ..... 345/540; 711/5; 711/157; 711/168; 345/539

(58) Field of Search ..... 345/540, 539, 345/531, 545, 550, 501; 711/157, 170, 5, 100, 154, 167, 168

(56) References Cited

U.S. PATENT DOCUMENTS 5,307,056 A * 4/1994 Urbanus ..... 345/543
5,587,726 A * 12/1996 Moffat ..... 345/539
5,742,788 A * 4/1998 Priem et al. ..... 711/170
6,195,106 B1 * 2/2001 Deering et al. ..... 345/545
6,300,963 B1 * 10/2001 Urbanus et al. ..... 345/547

* cited by examiner

*Primary Examiner*—Kee M. Tung

(57) ABSTRACT

Some embodiments of a data channel that interleaves read and write access to a frame buffer include a bit-plane storage device, a single frame buffer, a data controller and a digital pixel display. Transferring data through the single frame buffer by interleaving reads and writes includes (1) alternately writing to the frame buffer and reading from the frame buffer portions of each bit-plane of a sequence bit-plane data; and (2) writing to said frame buffer so as to replace each said portion of a bit-plane in the frame buffer with a corresponding portion of a next bit-plane. By interleaving read and write accesses, a single frame buffer and less interface logic are necessary to transfer data from a storage device to a digital pixel display. In a three channel digital color pixel imaging device, this reduces the number of frame buffer SDRAM units from six to three, and significantly reduces the overall cost associated with implementing data flow through the data storage and frame buffer blocks.

24 Claims, 6 Drawing Sheets

METHOD AND APPARATUS FOR INTERLEAVING READ AND WRITE ACCESSES TO A FRAME BUFFER

The present invention is directed towards a method and apparatus for interleaving read and write accesses to a frame buffer.

BACKGROUND OF THE INVENTION

Digital imaging involves processing digital images to direct the time-dependent switching of an array of pixels in a digital display. In this application, digital imaging is described with respect to digital color displays, but it may be applied to any device that receives digital data and produces a pixelated digital image.

Color displays generate color images by modulating, analyzing, and combining component color bands. Color displays typically use several component colors (such as the primary additive colors, red, green and blue) to generate a multitude of colors for display. A component color band is a portion of the light spectrum corresponding to a component color.

Digital color imaging transfers a digital color image to a digital color pixel display The digital color image is typically separated into three sets of color intensity data corresponding to the three component colors. The three sets of color intensity data are processed through three separate data channels, and recombined at the display.

The color intensity data for each color band is preferably transferred to the display using inexpensive circuitry having limited bandwidth. It is thus advantageous to re-order the color intensity data and store it as a sequence of single-bit arrays of image data (referred to below as bit-planes). The bit-planes are commonly stored in a bit-plane buffer, and then delivered sequentially to frame buffers. Once stored in a frame buffer, the bit-planes are then read out to the display in order to control the display pixels.

Each bit of data in a bit-plane has a specific storage site in a frame buffer and controls a corresponding specific pixel on the display. Thus, a bit-plane can be subdivided into blocks of data that are stored in specified portions of a frame buffer called data banks. These data banks control discrete subdivisions (pixel banks) of the array of pixels in the display.

A data channel of a digital imaging device 100 is illustrated in FIG. 1. As shown in FIG. 1, digital imaging device 100 includes (1) a digital image processor 110; (2) a gamma corrector 120; (3) a bit-plane remapper 130; (4) a bit-plane buffer 140; (5) data select circuitry 150 and 155; (6) frame buffers 160 and 165; (7) memory controllers 170 and 175; and (8) a digital pixel display 180.

The digital image processor 110 receives either a digital input 102, or an analog input 104. Analog input is converted to digital input by an analog to digital (A/D) converter 115 that is connected to or is a part of the digital image processor 110. The digital image processor 110 can perform a number of processing operations on the digital image. For instance, it can perform scaling, frame rate conversion, smoothing, etc. The gamma corrector 120 receives the processed digital image from the digital image processor 110, and adjusts the image intensity data to correct for the data and display type. The gamma corrector 120 can, for example, receive 8-bit, 256 level intensity data from the digital image processor 110 and output adjusted level 10-bit intensity data. The bit-plane remapper 130 converts the gamma-corrected intensity data from a multi-bit single-array format to a format comprising a sequence of bit-planes. For example, the bit-plane remapper 130 can receive an array of 10-bit image intensity data from the gamma corrector 120 and remap it into 10 re-ordered bit-planes. These bit-planes are stored in a bit-plane buffer 140. The bit-plane buffer 140 can, for example, receive 10 re-ordered bit-planes from the bit-plane remapper 130, store them in order, and deliver their data to data select circuitry 150 when requested.

Data select circuitry 150 retrieves data from the bit-plane buffer 140 and stores it in the SDRAM of frame buffers 160 and 165, at locations in the frame buffer specified by addresses generated by the memory controllers 170 and 175. Data select circuitry 155 retrieves data from the locations in the frame buffer specified by the addresses generated by the memory controllers 170 and 175. Data select circuitry 155 commonly retrieves one bit-plane of data from one frame buffer (e.g., Frame Buffer A 160) while data select circuitry 150 is storing another bit-plane of data in the other frame buffer (e.g., Frame Buffer B 165)

At times specified by the memory controllers 170 and 175, data select circuitry 155 selects data from the specified data banks of the active frame buffer and transfers it to corresponding pixel banks of the display 180 to update parts of the image. The light valves of the display 180 are driven by the data retrieved from the frame buffers 160 and 165. The display 180 switches the pixel light valves of a pixel bank on or off as directed by each data set read out from a corresponding data bank of either Frame Buffer A 160 or Frame Buffer B 165.

Data is commonly transferred through Frame Buffer A 160 and Frame Buffer B 165 using the swing buffer approach illustrated in the swing buffer data flow diagram 200 of FIG. 2. As shown in FIG. 2, the swing buffer data flow diagram 200 includes: (1) Frame buffer A 160; (2) Frame buffer B 165; (3) data write processes 211, 212, 213 and 214; (4) data read processes 221, 222, 223 and 224; and (5) a time line 230.

Frame buffers 160 and 165 store bit-plane image data as described in reference to FIG. 1. Data write processes (writes) (e.g., 211–214) comprise transferring data from the bit-plane buffer 140, through data select 150, to a frame buffer (160 or 165). Data read processes (reads) (e.g., 221–224) comprise transferring data from a frame buffer (160 or 165), through data select 155, to the digital pixel display 180. The time line 230 shows the relative time when writes and reads are performed on Frame Buffer A 160 and Frame Buffer B 165.

Under the swing buffer approach 200, one bit-plane is typically read out from a previously filled Frame Buffer A 160, at 221, while a second bit-plane is concurrently written to Frame Buffer B 165, at 212. At the completion of the read and write operations 221 and 212, the roles of Frame Buffer A 160 and Frame Buffer B 165 are reversed. The second bit-plane is then read out from Frame Buffer B 165, at 222, while a third bit-plane is written to Frame Buffer A 160, at 213. By this method, half of the bit-planes of a bit-plane sequence stored in bit-plane buffer 140 are transferred through Frame Buffer A 160, and the other half are transferred through Frame Buffer B 165. For example, the first, third, fifth, seventh and ninth bit-planes of a ten bit-plane image may pass through Frame Buffer A 160 while the second, fourth, sixth, eighth and tenth bit-planes pass through Frame Buffer B 165.

This swing buffer approach to data flow requires two separate frame buffer devices along with appropriate steering logic to route the data. Separate memory controllers are further used to generate the correct addressing and commands for each of the frame buffer SDRAM's. Unfortunately, this circuitry is relatively complicated and expensive. Other prior known solutions to data flow through a frame buffer tradeoff cost for lower bus speeds that are attainable with programmable logic. These solutions exist in prototype form only.

Therefore, there is a need in the art for a method and apparatus for data flow through a frame buffer that requires less complicated circuitry. This data flow system should (1) require only one frame buffer per data channel; (2) require less interface logic; and (3) reduce the overall cost of a data flow solution for digital imaging.

SUMMARY OF THE INVENTION

Some embodiments of the invention comprise digital imaging devices that interleave read and write access to a frame buffer. By interleaving read and write access, a single storage device and less interface logic can be used to transfer bit-planes from a storage device to a display. In a three channel imaging device, this reduces the number of frame buffer SDRAM units from six to three, and significantly reduces the overall cost associated with implementing data flow through the data storage and frame buffer blocks of a digital imaging device.

A data channel having interleaved read and write access to a frame buffer includes (1) a storage device that stores sequences of bit-planes; (2) a frame buffer that stores the re-ordered bit-plane data in groups; (3) a data controller that directs the timing of data writes to and reads from the frame buffer; and (4) a display that turns pixels on and off as directed by received single-bit data.

In some embodiments, the process of transferring data through a single frame buffer by interleaving reads and writes to the frame buffer includes (1) alternately writing to the frame buffer and reading from the frame buffer portions of each bit-plane of a sequence of bit-plane data; and (2) writing to said frame buffer so as to replace each said portion of a bit-plane in the frame buffer with a corresponding portion of a next bit-plane.

In other embodiments, the process of interleaving reads and writes to the single frame buffer includes (1) alternately writing a portion of said data to said frame buffer and reading a portion of said data from said frame buffer; and (2) after reading a first portion of said data from said frame buffer, writing each said a portion of said data so as to replace a portion of said data in said frame buffer that had been previously read from said frame buffer.

In other embodiments, the process of interleaving reads and writes to the single frame buffer includes alternately writing a portion of said data to and reading a portion of said data from said frame buffer, wherein each said reading a portion of said data comprises reading a different portion of data than that written to said frame buffer during the immediately prior said writing a portion of said data.

BRIEF DESCRIPTION OF THE DRAWINGS

The novel features of the invention are set forth in the appended claims. However, for purpose of explanation, several embodiments of the invention are set forth in the following figures.

DETAILED DESCRIPTION OF THE INVENTION

The invention is directed towards method and apparatus for interleaving read and write accesses to a frame buffer, for use with a digital imaging device. In the following description, numerous details are set forth for purpose of explanation. However, one of ordinary skill in the art will realize that the invention may be practiced without the use of these specific details. In other instances, well-known structures and devices are shown in block diagram form in order not to obscure the description of the invention with unnecessary detail.

Figure 3:
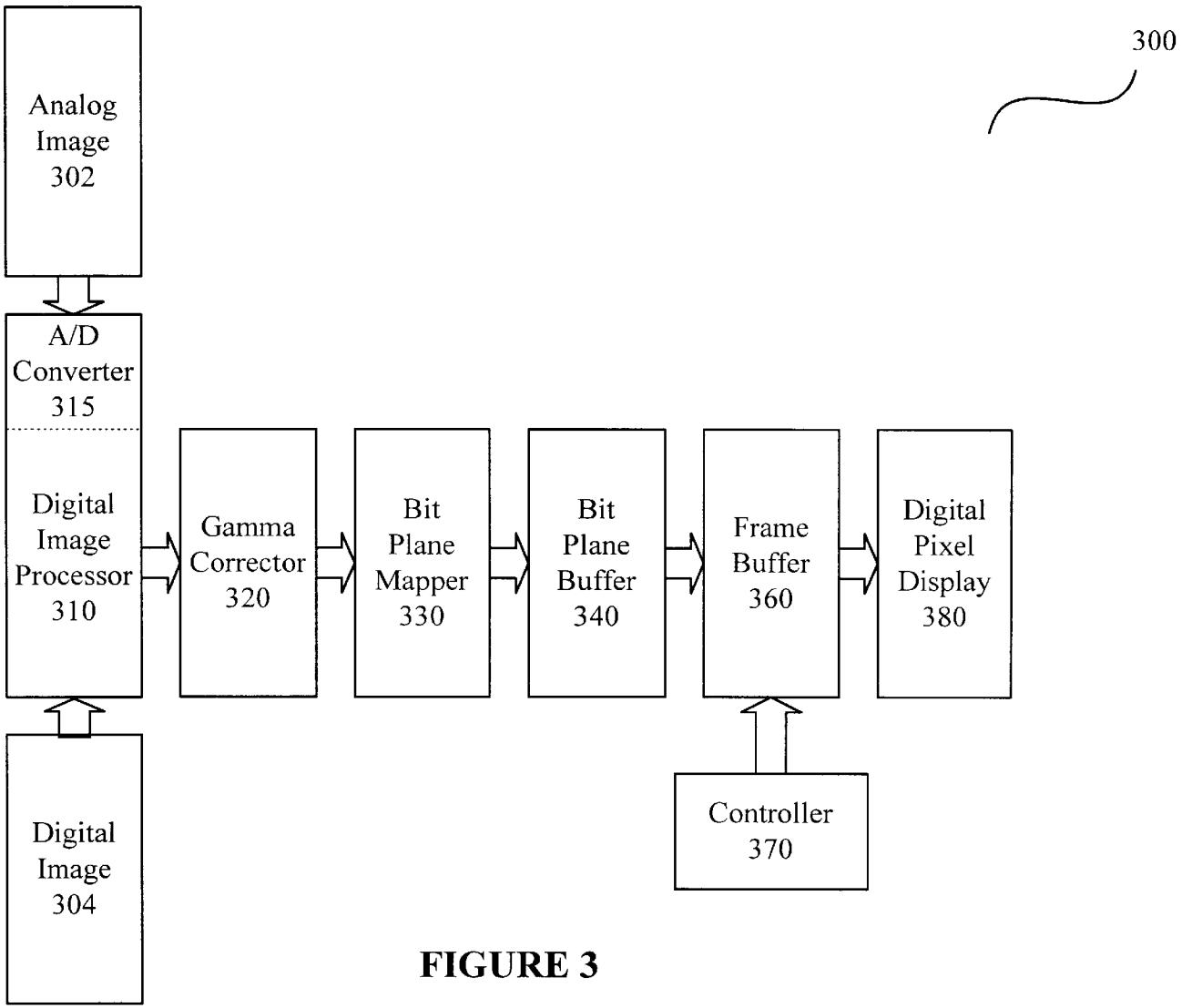
FIG. 3 illustrates an embodiment of the invention's digital imaging device.

FIG. 3 illustrates one channel of a digital imaging device used by some embodiments of the invention. As shown in FIG. 3, digital imaging channel 300 includes: (1) a digital image processor 310; (2) a gamma corrector 320; (3) a bit-plane remapper 330; (4) a bit-plane buffer 340; (5) a frame buffer 360; (6) a data flow controller 370; and (7) a digital pixel display 380.

The digital image processor 310 receives either a digital input 302, or an analog input 304. Analog input is converted to digital input by an analog to digital (A/D) converter 315 that is connected to or is a part of the digital image processor 310. The digital image processor 310 can perform a number of processing operations on the digital image. For instance, it can perform scaling, frame rate conversion, smoothing, etc. The gamma corrector 320 receives the processed digital image from the digital image processor 310 and adjusts the image intensity data to correct for the data and display type. The gamma corrector 320 can, for example, receive 8-bit, 256 level intensity data from the digital image processor 310 and output adjusted level 10-bit intensity data. The bit-plane remapper 330 converts the gamma corrected intensity data from a multi-bit single-array format to a format comprising a sequence of bit-planes. For example, the bit-plane remapper 330 can receive an array of 10-bit image intensity data from the gamma corrector 320 and remap it into 10 re-ordered bit-planes. These bit-planes are stored in bit-plane buffer 340. The bit-plane buffer 340 can, for example, receive 10 re-ordered bit-planes from the bit-plane remapper 330, store them in order, and deliver their data to the frame buffer 360 as requested.

The data flow controller 370 generates necessary addresses and control signals for driving the memory in the frame buffer 360. The data flow controller 370 retrieves specified data from the active bit-plane of the bit-plane buffer 340 and stores it in specified data banks of the frame buffer 360 at specified times. The data flow controller 370 also retrieves specified data from data banks of the frame buffer 360 and transfers it to the pixel banks of the display 380 at other specified times. The display 380 switches the pixel light valves of a pixel bank on or off as directed by each data set read from a corresponding data bank of the frame buffer 360.

In a preferred embodiment, each bit-plane is divided into 32 data sets. Each data set comprises data to control every $32^{nd}$ line of the digital pixel display. For example, a first data set may contain data for lines 1, 33, 65, etc., and a second data set may contain data for lines 2, 34, 66, etc. The 32 data sets are written to 32 data banks in the frame buffer and then read out to 32 corresponding pixel banks. Each pixel bank comprises every $32^{nd}$ line of the display as previously described.

Figure 4:
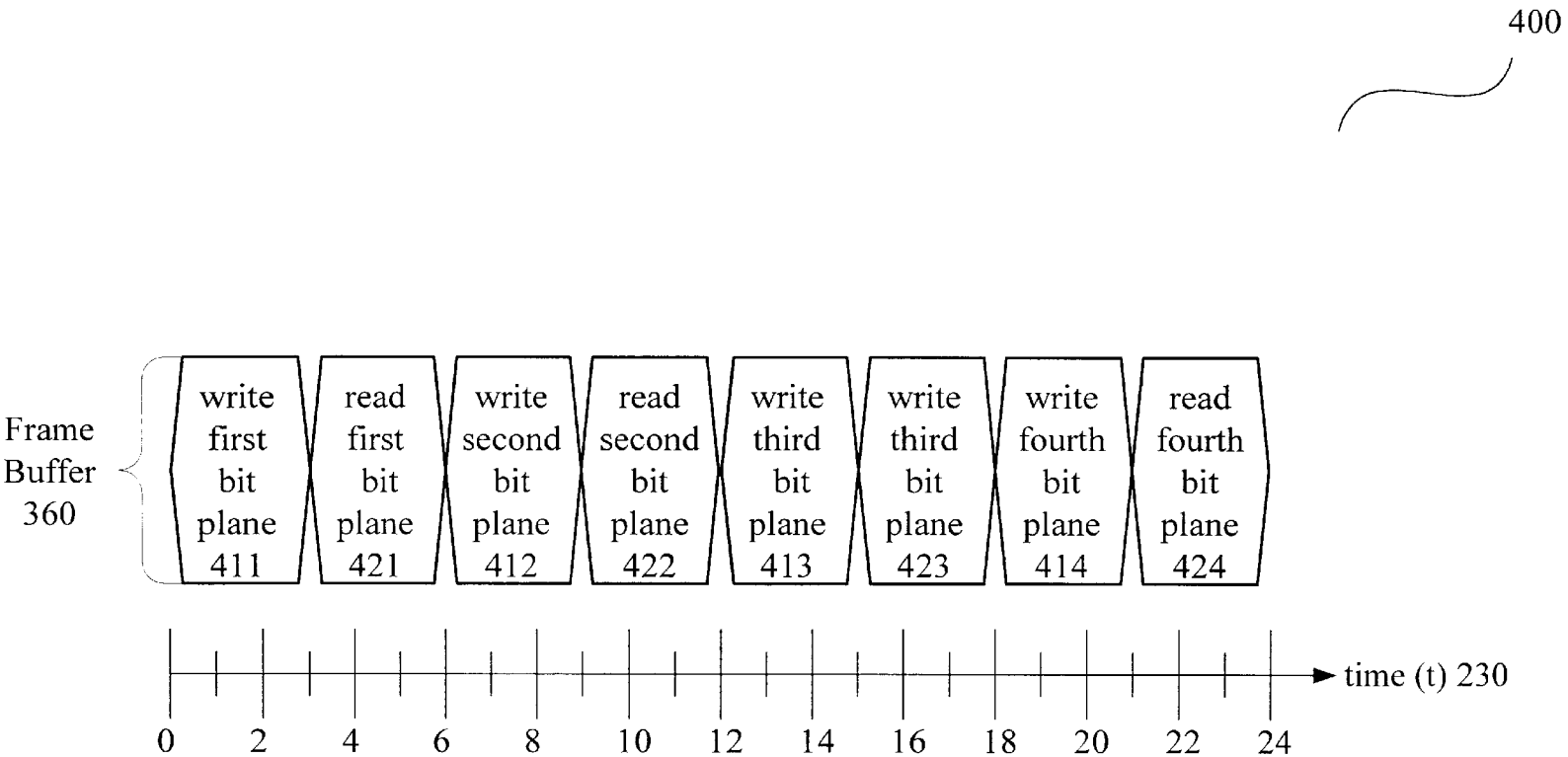
FIG. 4 illustrates a first embodiment of writing data into and reading data out from a single swing buffer of the invention's digital imaging device.

Data transfer through a single frame buffer 360 by interleaving read and write access to the frame buffer 360 is illustrated by the following embodiments of the invention. A first embodiment of an interleaved read and write access data transfer is illustrated in FIG. 4. As shown in FIG. 4, the interleaved read and write access data transfer 400 includes: (1) a frame buffer 360; (2) data write processes 411, 412, 413 and 414; (3) data read processes 421, 422, 423 and 424; and (4) a time line 230.

Figure 2:
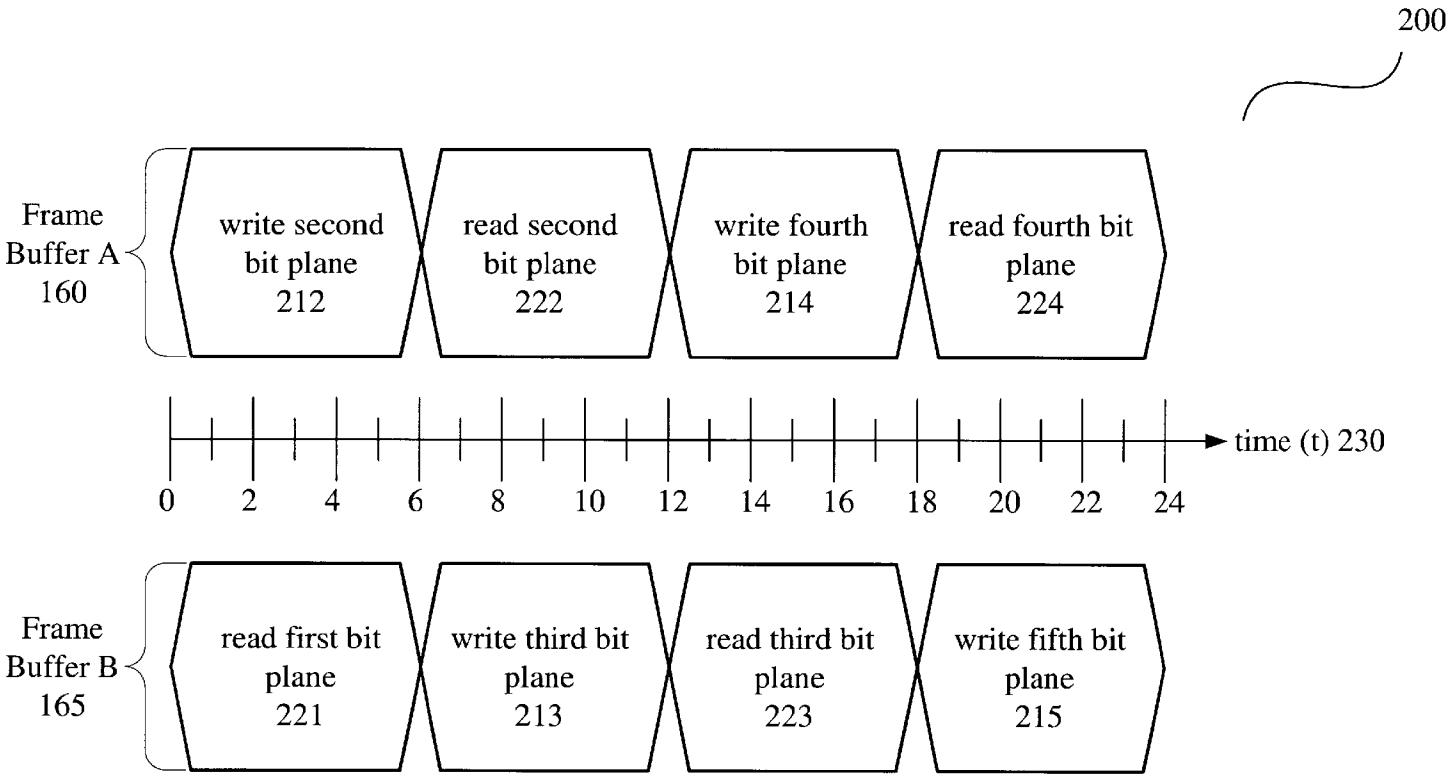
FIGURE 2 Prior Art
FIG. 2 illustrates writing data into and reading data out from two frame buffers using a swing buffer approach.

Frame buffer 360 stores bit-planes of image data as described in reference to FIG. 3. Data write processes (writes) (e.g., 411–414) comprise transferring bit-planes from the bit-plane buffer 340, to the frame buffer 360. Data read processes (reads) (e.g., 421–424) comprise transferring bit-planes (in whole or in parts) from the frame buffer 360 to the display 380. The time line 230 shows the relative time when writes and reads are performed in the frame buffer 360, and has the same scale as in FIG. 2.

During an interleaved read and write access data transfer, access to the frame buffer alternates between writing data from the bit-plane buffer 340 to the frame buffer 360 and reading data from the frame buffer 360 to the digital pixel display 380. During the interleaved access data transfer 400, bit-plane writes from the bit-plane buffer 340 to the frame buffer 360, at 411, 412, 413 and 414 alternate with bit-plane reads from the frame buffer 360 to the digital pixel display 380, at 421, 422, 423 and 424.

Figure 5:
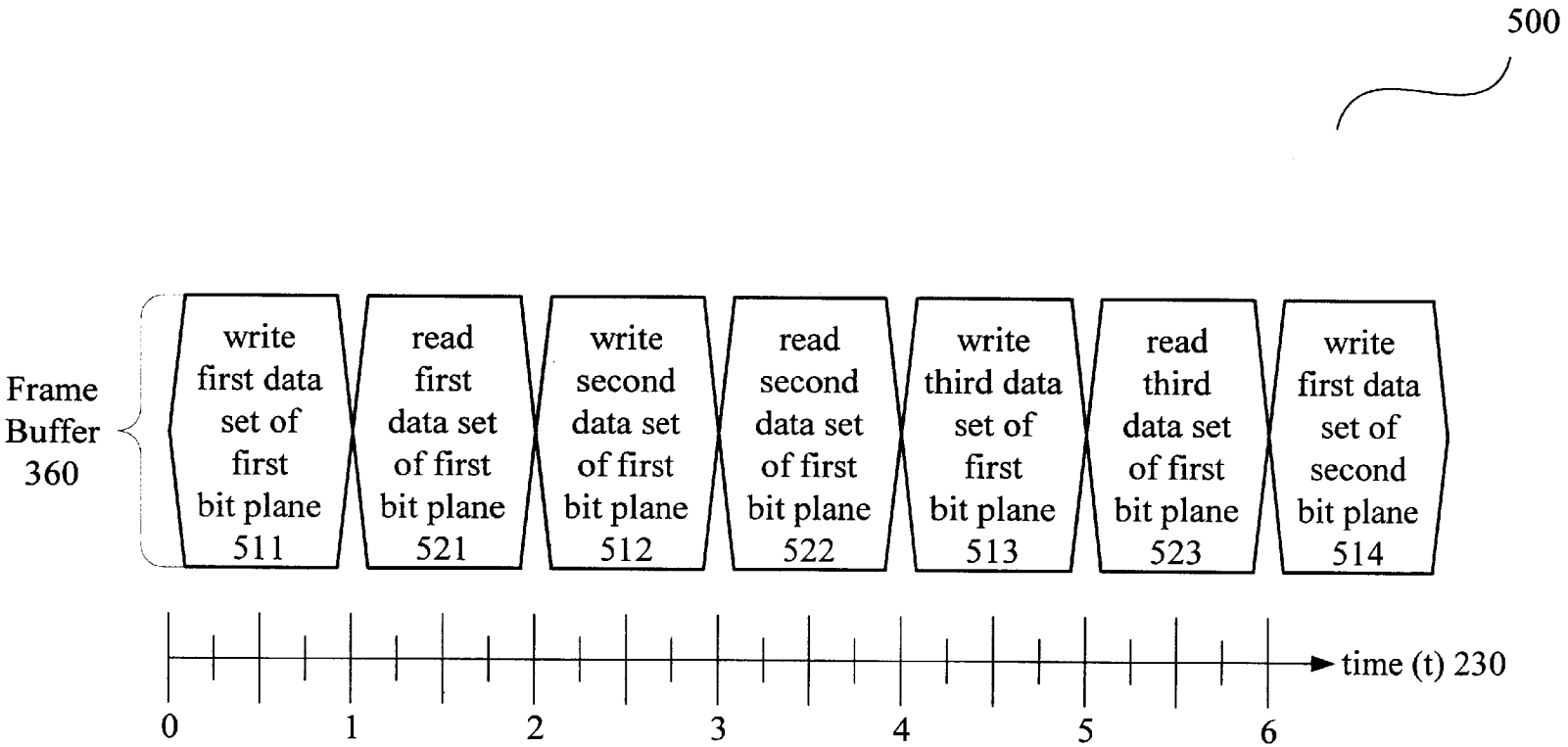
FIG. 5 illustrates a second embodiment of writing data into and reading data out from a single swing buffer of the invention's digital imaging device.

A second embodiment of an interleaved read and write access data transfer is illustrated in FIG. 5. As shown in FIG. 5, the interleaved read and write access data transfer 500 includes: (1) a frame buffer 360; (2) data write processes 511, 512, 513 and 514; (3) data read processes 521, 522 and 523; and (4) a time line 230.

Frame buffer 360 stores bit-planes of image data as described in reference to FIG. 3. Data writes (e.g., 511–514) comprise transferring portions of bit-planes (data sets) from the bit-plane buffer 340, to selected data banks of the frame buffer 360. Data reads (e.g., 521–523) comprise transferring data sets from selected data banks of the frame buffer 360 to the corresponding pixel banks of the display. The time line 230 shows the relative time when writes and reads are performed in the frame buffer 360, and has the same scale as in FIG. 2.

In the interleaved access data transfer 500 shown in FIG. 5, a portion of a bit-plane (e.g., a first data set of a first bit-plane) is written, at 511, from the bit-plane buffer 340 to a first data bank of the frame buffer 360, and then read, at 521, from the first data bank of the frame buffer 360 to the first pixel bank of the display 380. Subsequent data sets of the first bit-plane are then written from the bit-plane buffer 340 to other data banks of the frame buffer 360 (e.g., at 512 and 513) and read from the data banks of the frame buffer 360 to corresponding pixel banks of the display 380 (e.g., at 522 and 523). When the first bit-plane has been read from the data banks of the frame buffer 360, a first data set of a second bit-plane is written, at 514, to a first data bank of the frame buffer 360. Similar interleaving of the data sets of the second and subsequent bit-planes is performed as the process continues.

Figure 6:
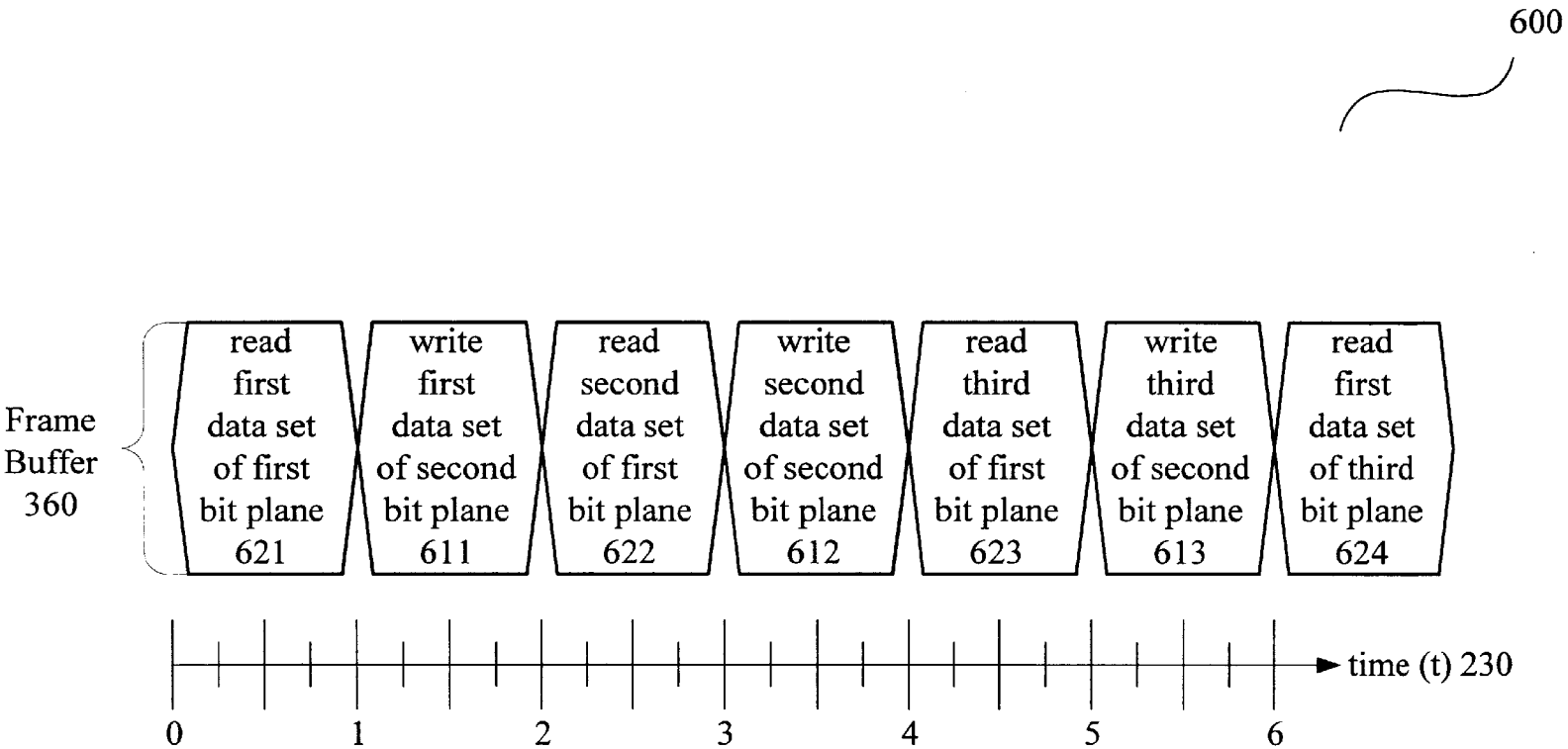
FIG. 6 illustrates a third embodiment of writing data into and reading data out from a single swing buffer of the invention's digital imaging device.

A third embodiment of an interleaved read and write access data transfer is illustrated in FIG. 6. As shown in FIG. 6, the interleaved read and write access data transfer 600 includes: (1) a frame buffer 360; (2) data write processes 611, 612 and 613; (3) data read processes 621, 622, 623 and 624; and (4) a time line 230.

Frame buffer 360 stores bit-planes of image data as described in reference to FIG. 3. Data writes (e.g., 611–613) comprise transferring portions of bit-planes (data sets) from the bit-plane buffer 340, to selected data banks of the frame buffer 360. Data reads (e.g., 621–624) comprise transferring data sets from selected data banks of the frame buffer 360 to the corresponding pixel banks of the display. The time line 230 shows the relative time when writes and reads are performed in the frame buffer 360, and has the same scale as in FIG. 2.

In the interleaved access data transfer 600 shown in FIG. 6, a portion of a bit-plane (e.g., a first data set of a first bit-plane) is read, at 621, from a first data bank of the frame buffer 360 to a first pixel bank of the display 380. Subsequently a first data set of a second bit-plane is written, at 611, from the bit-plane buffer 340 to the first data bank of frame buffer 360 (e.g., at 622 and 623). Subsequent data sets of the first bit-plane are read from other data banks of the frame buffer 360, and data sets from the second bit-plane are written to each data bank to replace the data sets that are read out (e.g., at 612 and 613). The data sets read out from the frame buffer 360 can be replaced by the immediately subsequent write process, as shown in FIG. 6. Alternatively, each data set read from the frame buffer 360 can be replaced by a write process that is performed after other read and write operations have been performed.

Figure 1:
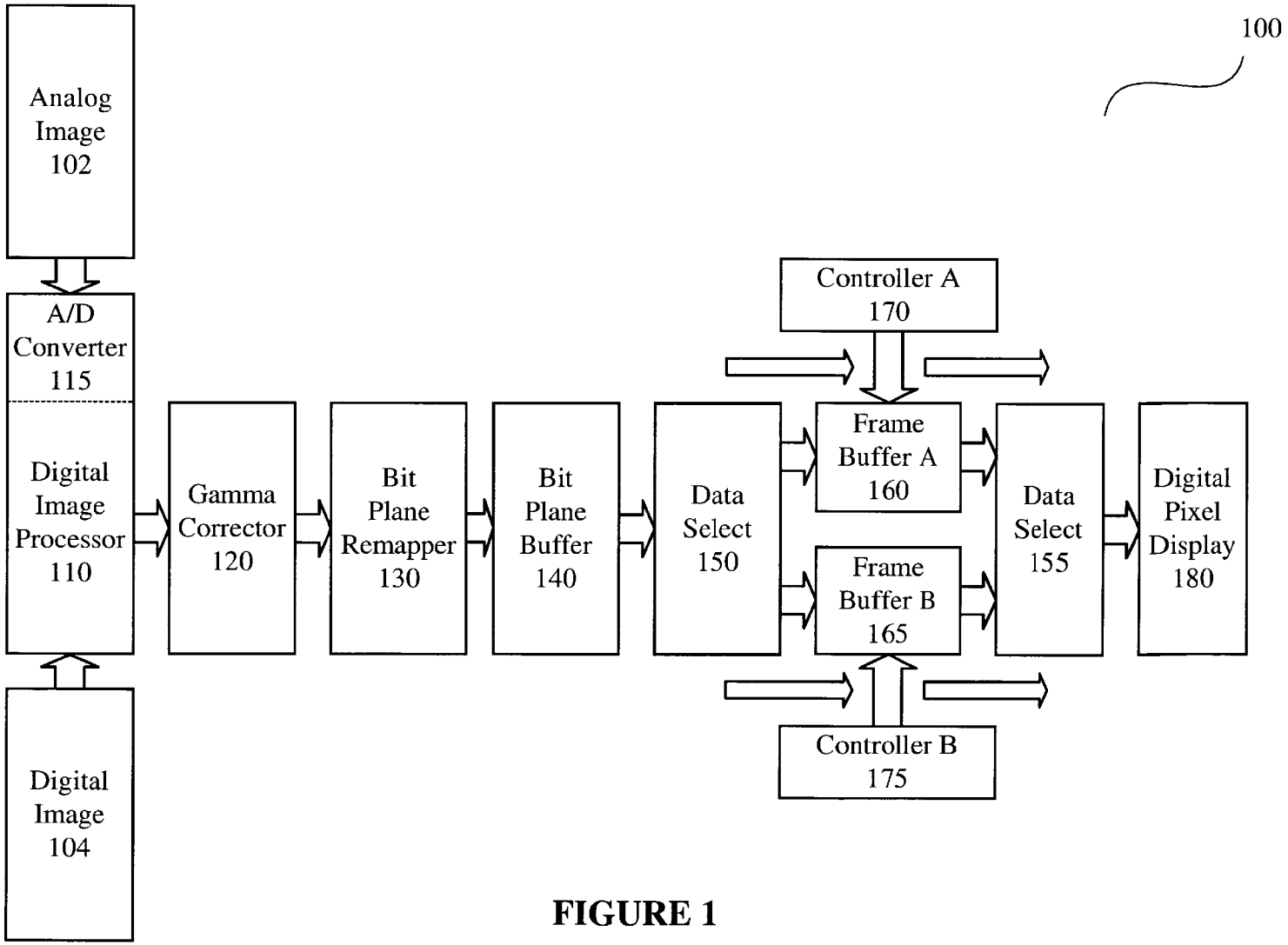
FIGURE 1 Prior Art
FIG. 1 illustrates a digital imaging device.

The embodiments of interleaved read and write access data transfer have several advantages. All of the bit-planes of a bit-plane sequence stored in bit-plane buffer 340 are transferred through a single frame buffer 360 to the display 380. Thus, the single frame buffer 360 of interleaved access digital imaging channel 300 performs the same transfer of bit-plane data as a two frame buffer swing buffer system 100 of FIG. 1. Therefore, only one frame buffer and only one memory controller are required per data channel. The data-path select logic is also eliminated, and less bus routing is required.

While the invention has been described with reference to numerous specific details, one of ordinary skill in the art will recognize that the invention can be embodied in other specific forms without departing from the spirit of the invention. For instance, the embodiments described above use gamma corrected 10-bit pixel intensity data and 3-channel digital color pixel imaging devices, but the invention is equally applicable to other pixel data formats, other types of pixel display devices, and more or less data channels. Thus, one of ordinary skill in the art would understand that the invention is not to be limited by the foregoing illustrative details, but rather is to be defined by the appended claims.

We claim:

1. A method for transferring bit-plane data to and from a frame buffer, said method interleaving write and read accesses to said frame buffer, said method comprising:

alternately writing to said frame buffer and reading from said frame buffer at least two portions of each bit-plane of said bit-plane data; and writing to said frame buffer so as to replace each of said portions of each bit-plane in said frame buffer with a corresponding portion of a next bit-plane.

2. The method as claimed in claim 1, wherein said frame buffer comprises a data storage array that is divided into at least two data banks, each data bank capable of storing a corresponding one of said at least two portions of each bit-plane.

3. The method as claimed in claim 2, wherein each of said at least two portions of a bit-plane is read from one of said at least two data banks to a corresponding one of at least two pixel banks of a digital pixel display.

4. The method as claimed in claim 1, wherein prior to said alternately writing a portion of said data to and reading a portion of said data from said frame buffer, the method further comprises:

receiving one of a digital pixel image and an analog image;

upon receiving an analog image, converting said analog image into a digital pixel image;

image processing said digital pixel image;

gamma correcting said digital pixel image;

remapping said digital pixel image into an ordered sequence of bit-planes; and storing said ordered sequence of bit-planes in a storage device.

5. An apparatus for transferring data to and from a frame buffer, said apparatus comprising:

a storage device storing digital pixel image data as a sequence of bit-planes;

a frame buffer capable of storing one of said bit-planes;

a digital pixel display that includes an array of pixel sites corresponding to an array of single-bits comprising each of said bit-planes;

circuitry that controls data transfer from said storage device to said frame buffer and from said frame buffer to said digital pixel display; and a first program code to transfer said data by interleaving read and write accesses to said frame buffer, said program code comprising:

alternately writing to said frame buffer and reading from said frame buffer at least two portions of each bit-plane of said bit-plane data; and writing to said frame buffer so as to replace each of said portions of each bit-plane in said frame buffer with a corresponding portion of a next bit-plane.

6. The apparatus as claimed in claim 5, wherein said frame buffer comprises a data storage array that is divided into at least two data banks, each data bank capable of storing a corresponding one of said at least two portions of each bit-plane.

7. The apparatus as claimed in claim 6, wherein each of said at least two portions of a bit-plane is read from one of said at least two data banks to a corresponding one of at least two pixel banks of the digital pixel display.

8. The apparatus as claimed in claim 5, further comprising:

a device to at least one of receive a digital pixel image, and receive an analog image and convert said analog image into a digital pixel image;

a device to process said digital pixel image;

a device to gamma correct said digital pixel image; and a device to remap said digital pixel image into an ordered sequence of bit-planes.

9. A method for transferring data to and from a frame buffer, said method interleaving write and read accesses to said frame buffer, said method comprising:

alternately writing a portion of said data to said frame buffer and reading a portion of said data from said frame buffer; and after writing a portion of said data to each data bank in said frame buffer, writing each subsequent portion of said data to said frame buffer so as to replace a portion of said data in said frame buffer that had been previously read from said frame buffer, wherein said data includes at least one sequence of bit-planes and said frame buffer includes a data storage array corresponding to an array of single-bit data that comprises each of said bit-planes.

10. The method as claimed in claim 9, wherein each of said bit-planes comprises at least two bit-plane data sets, said data storage array comprises at least two corresponding data banks, and each portion of said data stored in said frame buffer comprises one of said bit-plane data sets and is stored in one of said data banks.

11. The method as claimed in claim 10, wherein said interleaving read and write accesses to said frame buffer further comprises:

a) writing a first bit-plane from a storage device to said frame buffer;

b) reading a first data set from a first data bank of said frame buffer to a digital pixel display;

c) writing a first data set from a second bit-plane in said storage device to said first data bank of said frame buffer;

d) alternately reading data sets from other data banks of said frame buffer and writing corresponding second bit-plane data sets to said other banks of said frame buffer until all data sets from said second bit-plane have been written from said storage device into said frame buffer; and e) repeating procedures b), c) and d) for writing third and subsequent bit-planes to said frame buffer.

12. The method as claimed in claim 9, wherein prior to said alternately writing a portion of said data to and reading a portion of said data from said frame buffer the method further comprises:

receiving one of a digital pixel image and an analog image;

upon receiving an analog image, converting said analog image into a digital pixel image;

image processing said digital pixel image;

gamma correcting said digital pixel image;

remapping said digital pixel image into an ordered sequence of bit-planes; and storing said ordered sequence of bit-planes in a storage device.

13. An apparatus for transferring data to and from a frame buffer, said apparatus comprising:

said data stored in a storage device;

a frame buffer;

a digital pixel display;

circuitry that controls data transfer from said storage device to said frame buffer and from said frame buffer to said digital pixel display; and a first program code to transfer said data by interleaving read and write accesses to said frame buffer, said program code comprising:

alternately writing a portion of said data to said frame buffer and reading a portion of said data from said frame buffer; and after reading a first portion of said data from said frame buffer, writing each said a portion of said data so as to replace a portion of said data in said frame buffer that had been previously read from said frame buffer, wherein said data includes at least one sequence of bit-planes and said frame buffer includes a data storage array corresponding to an array of single-bit data that comprises each of said bit-planes.

14. The apparatus as claimed in claim 13, wherein each of said bit-planes comprises at least two bit-plane data sets, said data storage array comprises at least two corresponding data banks, and each portion of said data stored in said frame buffer comprises one of said bit-plane data sets and is stored in one of said data banks.

15. The apparatus as claimed in claim 14, wherein said program for interleaving read and write accesses to said frame buffer further comprises:

a) writing a first bit-plane from a storage device to said frame buffer;

b) reading a data set from a first data bank of said frame buffer to a digital pixel display;

c) writing a first data set from a second bit-plane in said storage device to said first data bank of said frame buffer;

d) alternately reading data sets from other data banks of said frame buffer and writing corresponding second bit-plane data sets to said other banks of said frame buffer until all data sets from said second bit-plane have been written from said storage device into said frame buffer; and e) repeating procedures b), c) and d) for writing third and subsequent bit-planes to said buffer.

16. The apparatus as claimed in claim 13, further comprising:

a device to at least one of receive a digital pixel image, and receive an analog image data and convert said analog image into a digital pixel image;

a device to process said digital pixel image;

a device to gamma correct said digital pixel image; and a device to remap said digital pixel image into an ordered sequence of bit-planes.

17. The apparatus as claimed in claim 13, wherein said apparatus further comprises:

circuitry that controls data transfer to said digital pixel display through at least two data channels; and at least two frame buffers, one frame buffer connected to each of said at least two data channels.

18. The apparatus as claimed in claim 17, wherein said apparatus further comprises:

a digital color imaging device that receives single-bit pixel data for three color bands through three data channels;

circuitry that controls data transfer to said imaging device through three data channels; and three frame buffers, one frame buffer connected to each of said three data channels.

19. A method for transferring data to and from a frame buffer, said method alternately writing a portion of said data to and reading a portion of said data from said frame buffer, wherein each said reading a portion of said data comprises reading a different portion of data than that written to said frame buffer during the immediately prior said writing a portion of said data, wherein said data includes at least one sequence of bit-planes and said frame buffer includes a data storage array corresponding to an array of single-bit data that comprises each of said bit-planes.

20. The method as claimed in claim 19, wherein each of said bit-planes comprises at least two bit-plane data sets, said data storage array comprises at least two corresponding data banks, and each portion of said data stored in said frame buffer comprises one of said bit-plane data sets and is stored in one of said data banks.

21. The method as claimed in claim 19, wherein prior to said alternately writing a portion of said data to and reading a portion of said data from said frame buffer the method further comprises:

receiving one of digital pixel image and an analog image;

upon receiving an analog image, converting said analog image into a digital pixel image;

image processing said digital pixel image;

gamma correcting said digital pixel image;

remapping said digital pixel image into an ordered sequence of bit-planes; and storing said ordered sequence of bit-planes in a storage device.

22. An apparatus for transferring data to and from a frame buffer, said apparatus comprising:

data stored in a storage device;

a frame buffer;

a digital pixel display;

circuitry that controls data transfer from said storage device to said frame buffer and from said frame buffer to said digital pixel display; and a first program code to transfer said data by alternately writing a portion of said data to and reading a portion of said data from said frame buffer, wherein each said reading a portion of said data comprises reading a different portion of data than that written to said frame buffer during the immediately prior said writing a portion of said data, wherein said data includes at least one sequence of bit-planes and said frame buffer includes a data storage array corresponding to an array of single-bit data that comprises each of said bit-planes.

23. The apparatus as claimed in claim 22, wherein each of said bit-planes comprises at least two bit-plane data sets, said data storage array comprises at least two corresponding data banks, and each portion of said data stored in said frame buffer comprises one of said bit-plane data sets and is stored in one of said data banks.

24. The apparatus as claimed in claim 22, further comprising:

a device to at least one of receive a digital pixel image, and receive an analog image and convert said analog image into a digital pixel image;

a device to process said digital pixel image;

a device to gamma correct said digital pixel image; and a device to remap said digital pixel image into an ordered sequence of bit-planes.

* * * * *